US011846449B2

(12) United States Patent
Rao et al.

(10) Patent No.: US 11,846,449 B2
(45) Date of Patent: Dec. 19, 2023

(54) COMBUSTION SYSTEMS WITH EASE OF SERVICEABILITY

(71) Applicant: Rheem Manufacturing Company, Atlanta, GA (US)

(72) Inventors: Ashwin Rao, Montgomery, AL (US); Jason Hall, Prattville, AL (US); William Tomlin McLemore, Montgomery, AL (US); Ronnie Eaton, Montgomery, AL (US); Sina Jasteh, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 85 days.

(21) Appl. No.: 16/862,972

(22) Filed: Apr. 30, 2020

(65) Prior Publication Data

US 2021/0341176 A1 Nov. 4, 2021

(51) Int. Cl.

| | |
|---|---|
| ***F24H 1/00*** | (2022.01) |
| ***F24H 9/1836*** | (2022.01) |
| ***F24H 9/20*** | (2022.01) |
| ***F23M 11/04*** | (2006.01) |
| *F23D 14/36* | (2006.01) |

(52) U.S. Cl.

CPC ..... *F24H 1/0036* (2013.01); *F23M 11/042* (2013.01); *F24H 9/1836* (2013.01); *F24H 9/2035* (2013.01); *F23D 14/36* (2013.01); *F23D 2203/1012* (2013.01); *F23D 2207/00* (2013.01); *F23D 2208/10* (2013.01); *F23D 2213/00* (2013.01); *F23D 2900/00017* (2013.01); *F23N 2900/05005* (2013.01)

(58) Field of Classification Search

CPC .... F24H 9/2035; F24H 9/1836; F24H 1/0036; F23M 11/042; F23D 2900/00017; F23D 2213/00; F23D 2208/10; F23D 2207/00; F23D 2203/1012; F23D 14/36; F23N 2900/05005

USPC ..... 431/13

See application file for complete search history.

(56) References Cited

U.S. PATENT DOCUMENTS

| | | | | |
|---|---|---|---|---|
| 4,643,672 A * | 2/1987 | Lefebvre | F23D 11/406 | 431/265 |
| 5,865,616 A * | 2/1999 | George | F23D 14/02 | 431/284 |
| 6,443,728 B1 * | 9/2002 | Edberg | F23D 14/22 | 431/264 |

(Continued)

*Primary Examiner* — Steven B McAllister
*Assistant Examiner* — Benjamin W Johnson
(74) *Attorney, Agent, or Firm* — Eversheds Sutherland (US) LLP

(57) ABSTRACT

The disclosed technology includes a combustion system providing ease of access to components of the combustion system and optimal placement of a burner such that efficient combustion and heat transfer can occur. The combustion system can include an inner tube having a first end and a second end, the second end having a flange with a sensor port, and an outer tube having a first end and a second end. The inner tube can be disposed within the outer tube. The inner tube can have an outer diameter less than an inner diameter of the outer tube, creating a gap between the outer tube and inner tube. An ignitor assembly and a flame sensor assembly can extend through the sensor port and the gap and be positioned proximate a burner.

20 Claims, 9 Drawing Sheets

(56) References Cited

U.S. PATENT DOCUMENTS

2012/0282555 A1* 11/2012 Cody ..... F23G 7/085
431/5
2020/0158336 A1* 5/2020 Davis ..... F23N 5/082

* cited by examiner

COMBUSTION SYSTEMS WITH EASE OF SERVICEABILITY

FIELD OF THE DISCLOSURE

The presently disclosed subject matter relates generally to a combustion system, and more particularly to a combustion system that provides ease of serviceability.

BACKGROUND

Down-fired water heaters are commonly used in both commercial and residential applications to provide on-demand hot water to various types of hot water-utilizing fixtures including sinks, showers, dishwashers, and the like. A down-fired water heater can have a combustion system including a burner, a flame sensor assembly, an ignitor assembly, and a blower assembly. The combustion system can be mounted to a combustion tube disposed within a tank such that the flame sensor assembly, ignitor assembly, and burner are disposed within the combustion tube. Hot combustion gases generated during combustion can travel through the combustion tube to the heat exchanger. The heat from the hot combustion gases can be transferred to the water stored in the tank to provide on-demand hot water.

Maintenance of a water heater is needed to ensure the water heater can operate effectively and efficiently. During the lifespan of a water heater, various components, including the flame sensor assembly, ignitor assembly, burner assembly, gaskets, and combustion tubes, can require maintenance and cleaning. In some instances, the flame sensor assembly and the ignitor assembly can require maintenance and/or cleaning at least once a year. When completing maintenance of the flame sensor assembly and the ignitor assembly, it can be necessary for the flame sensor assembly and the ignitor assembly to be removed from the combustion system.

Regular maintenance of components of the water heater can be challenging in combustion systems known in the prior art. FIG. 1 provides an example of a prior combustion system 1. As illustrated in FIG. 1, the components can be fixed together, and the combustion system 1 can be inserted within a combustion tube of a water heater, such that the extension tube 2, the burner 3, the ignitor assembly 4, and the flame sensor assembly 5 are disposed within the combustion tube. In this configuration, an individual component cannot be accessed and/or removed without first removing other components or by removing the entire combustion system. By way of example, in order to remove the ignitor assembly 4 or the flame sensor assembly 5 and provide adequate maintenance, it can be necessary to disassemble and remove the blower assembly 6, the extension tube 2, and the burner 3. Disassembling and removing multiple components of the combustion system can require removing many screws and gaskets, resulting in excessive labor costs and time necessary for service of the water heater.

Additionally, when the combustion system is mounted to a combustion tube of a water heater, the burner can be positioned closer to the heat exchanger and the storage tank. This can provide optimal combustion and heat transfer. For example, certain designs can position the combustion system—and more particularly, the burner—lower in the heat exchanger in attempts to reduce uneven tank temperatures. However, if the burner is disposed too deep within the combustion tube, the flame sensor assembly, ignitor assembly, burner assembly, gaskets, and combustion tubes can become difficult to access and/or remove. Thus, existing systems that located the burner lower within the water heater may provide more even water temperatures throughout the tank, but doing so can negatively impact serviceability and manufacturability/assembly.

For these reasons, a need exists for systems, devices, and methods for a combustion system that provides ease of serviceability of various components of a water heater, including the flame sensor assembly, ignitor assembly, burner assembly, and gaskets while also positioning the combustion system such that optimal combustion and heat transfer can be achieved.

SUMMARY

These and other problems can be addressed by examples and implementations of the technology disclosed herein. Examples of the present disclosure relate generally to a combustion system including an inner tube disposed within an outer tube, the inner tube having a flange with a sensor port that can provide ease of serviceability of various components of the combustion system.

The disclosed technology includes a combustion system including an outer tube and an inner tube. The outer tube can include a first end and a second end. The first end of the outer tube can be in communication with a burner. The inner tube can include an outer diameter, a first end, a second end, and a flange having a sensor port. The inner tube can be disposed within the outer tube. The outer diameter of the inner tube can be less than an inner diameter of the outer tube such that a gap exists between the inner tube and the outer tube when the inner tube is disposed within the outer tube. The flange of the inner tube can be attached to the first end of the outer tube. The sensor port can be aligned with the gap. The combustion system can include an ignitor assembly and a flame sensor assembly. The ignitor assembly and the flame sensor assembly can extend through the sensor port and the gap and be positioned proximate to the burner. The burner can be in communication with the first end of the inner tube.

The sensor port can be sized such that the ignitor assembly and the flame sensor assembly can each be accessible and removable through the sensor port. The ignitor assembly and the flame sensor assembly can each be removable without removing the burner.

The disclosed technology also includes a combustion tube assembly including an outer tube and an inner tube. The outer tube can have a first end and a second end. The inner tube can have a first end, a second end, and a flange having a sensor port. The inner tube can be configured to at least partially insert into the outer tube. The inner tube can have an outer diameter less than an inner diameter of the outer tube such that a gap exists between the inner tube and the outer tube when the inner tube is inserted into the outer tube. The combustion tube assembly can include a burner configured to attach to the first end of the outer tube. The combustion tube assembly can include an ignitor assembly and a flame sensor assembly. The ignitor assembly and the flame sensor assembly can be configured to extend through the sensor port and the gap and be positioned proximate the burner.

These and other aspects of the present disclosure are described in the Detailed Description below and the accompanying figures. Other aspects and features of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various other examples of the disclosure discussed herein. In similar fashion, while examples may be discussed below as devices, systems, or methods, it is to be understood that such examples can be implemented in various devices, systems, and methods of the present disclosure.

BRIEF DESCRIPTION OF THE FIGURES

Reference will now be made to the accompanying figures, which are not necessarily drawn to scale, and wherein.

DETAILED DESCRIPTION

Figure 1:
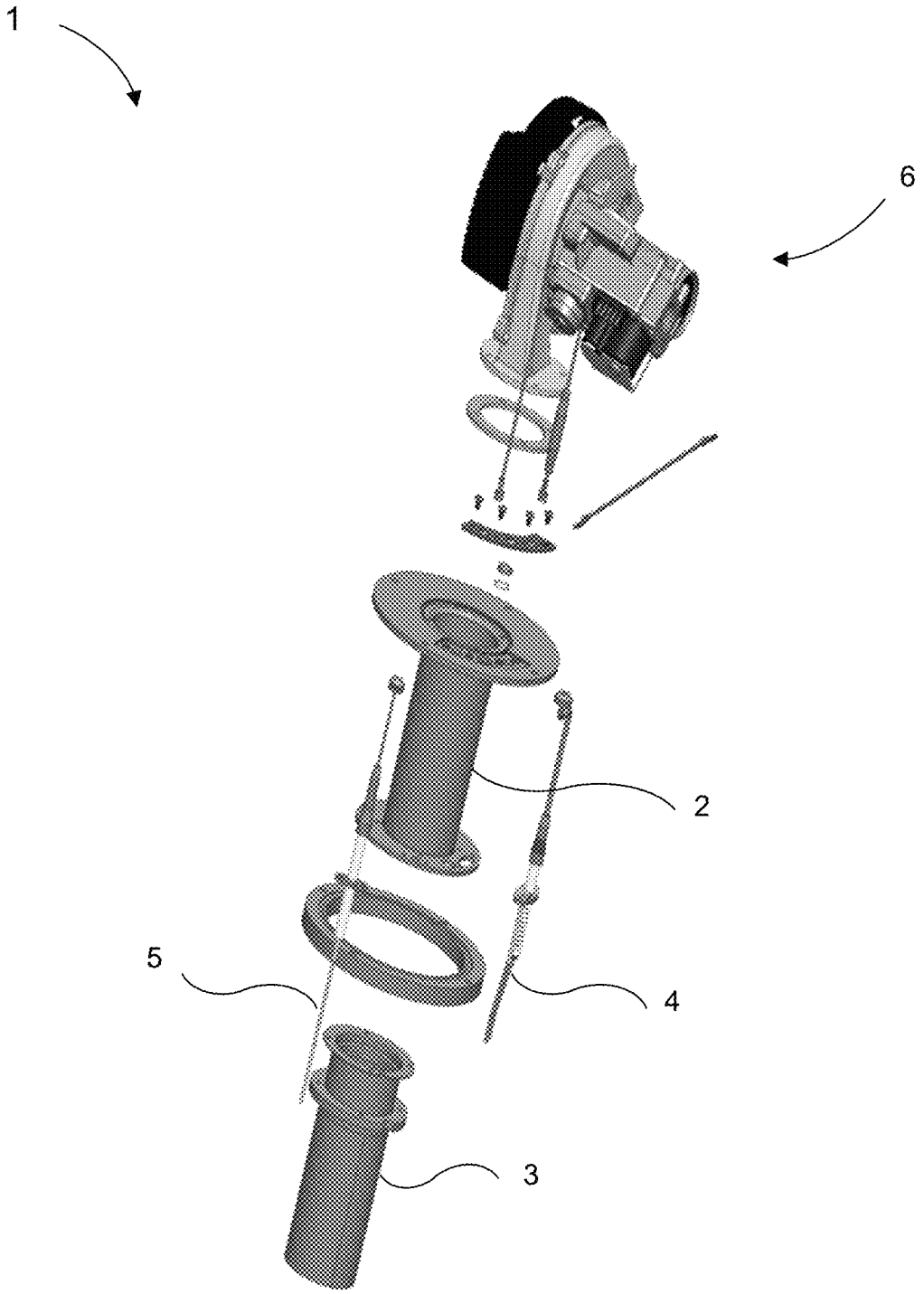
FIG. 1 PRIOR ART
FIG. 1 illustrates an example combustion system, according to prior art.

The disclosed technology relates to a combustion system providing ease of access and ease of manufacturability of various components of the combustion system, including an ignitor assembly, a flame sensor assembly, sight glass assembly, burner assembly, and various gaskets and fasteners, while optimally positioning the burner within a combustion tube such that efficient combustion and heat transfer can occur. The combustion system can include an inner tube disposed within an outer tube. The top end of the inner tube can have a flange with a sensor port. The inner tube can have a smaller outer diameter than the inner diameter of the outer tube, creating a gap between the interior wall of the outer tube and the exterior wall of the inner tube. A flame sensor assembly and an ignitor assembly can extend through the sensor port and gap and be positioned proximate to the burner. The sensor port can be aligned with the gap and sized such that the flame sensor assembly and the ignitor assembly each can be accessible and removable through the sensor port without having to remove additional components of the combustion system. This ease of accessibility can allow the flame sensor and ignitor assembly to be serviced and cleaned efficiently and without substantially disassembling portions of the combustion system.

Examples of the disclosed technology are discussed herein with reference to heating "fluid" or "water." It is to be appreciated that the disclosed technology can be used with a variety of fluids, including water. Thus, while some examples may be described in relation to heating water specifically, all examples of the disclosed technology can be used with fluids other than water unless otherwise specified.

The disclosed technology will be described more fully hereinafter with reference to the accompanying drawings. This disclosed technology can, however, be embodied in many different forms and should not be construed as limited to the examples set forth herein. The components described hereinafter as making up various elements of the disclosed technology are intended to be illustrative and not restrictive. Many suitable components that would perform the same or similar functions as components described herein are intended to be embraced within the scope of the disclosed electronic devices and methods. Such other components not described herein can include, but are not limited to, for example, components developed after development of the disclosed technology.

In the following description, numerous specific details are set forth. But it is to be understood that examples of the disclosed technology can be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described can include a particular feature, structure, or characteristic, but not every embodiment necessarily includes the particular feature, structure, or characteristic. Further, repeated use of the phrase "in one embodiment" does not necessarily refer to the same embodiment, although it can.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described should be in a given sequence, either temporally, spatially, in ranking, or in any other manner.

Unless otherwise specified, all ranges disclosed herein are inclusive of stated end points, as well as all intermediate values. By way of example, a range described as being "from approximately 2 to approximately 4" includes the values 2 and 4 and all intermediate values within the range. Likewise, the expression that a property "can be in a range from approximately 2 to approximately 4" (or "can be in a range from 2 to 4") means that the property can be approximately 2, can be approximately 4, or can be any value therebetween.

The disclosed technology aims to provide a combustion system 100 providing ease of access to the ignitor assembly 114 and the flame sensor assembly 116, while also positioning the burner 112 for efficient combustion and heat transfer. The components and arrangements shown in the FIGS. 2A through 8B are not intended to limit the disclosed embodiments as the components used to implement the disclosed processes and features may vary. That is, while certain principles of the present invention are described as being incorporated in a gas-fired water tank heater, this example is non-limiting, and it will be readily appreciated by those skilled in the art that fuel-fired heating appliances of other types may be utilized alternatively.

Figure 2A:
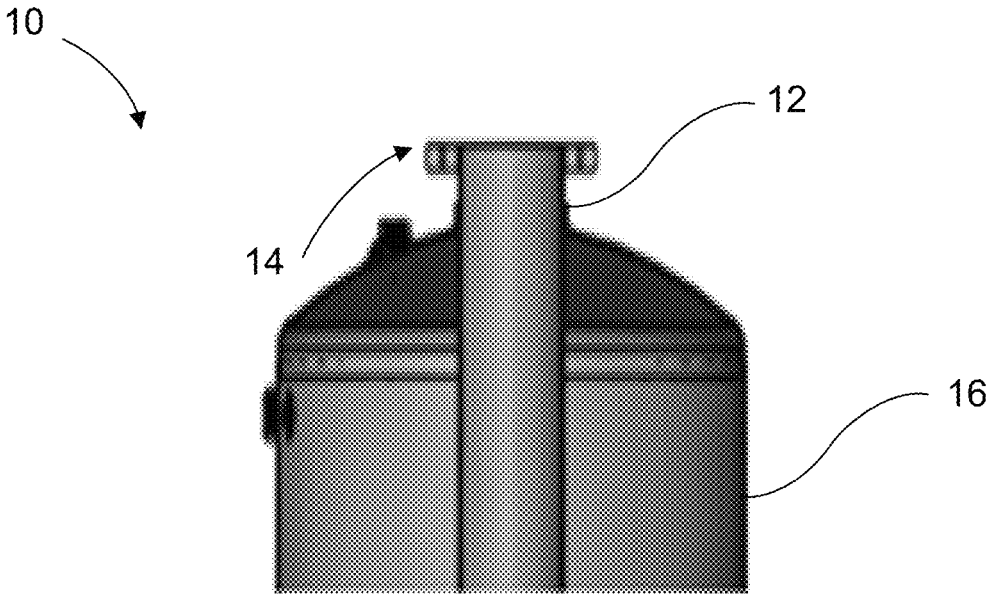
FIG. 2A illustrates a fluid heating device having a combustion tube, according to the disclosed technology.
Figure 2B:
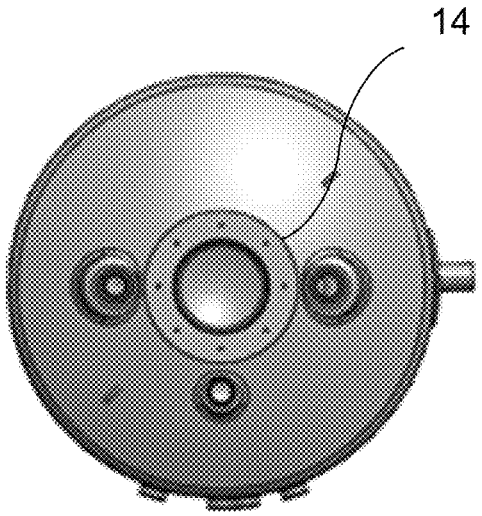
FIG. 2B illustrates a tank ring, according to the disclosed technology.

Referring now to the drawings, FIG. 2A illustrates a fluid heating device 10 including a combustion tube 12 disposed within a tank 16. The tank 16 can be a vertically oriented metal tank adapted to hold a quantity of water for on-demand delivery to hot water-utilizing fixtures including sinks, showers, dishwashers, and the like. A combustion tube 12 can extend through a top surface of the fluid heating device 10 and into the tank 16. A portion of the combustion tube 12 can protrude from a top end of the fluid heating device 10. Hot combustion gases generated during combustion can travel down the combustion tube 12 and through a heat exchanger, such that the water in the tank 16 can become heated. A tank ring 14 can be affixed to a top end of the combustion tube 12. The tank ring 14 can be welded to the combustion tube 12. As illustrated in FIG. 2B, the tank ring 14 can include one or more attachment mechanisms configured to affix a combustion system 100 to the combustion tube 12.

Figure 3:
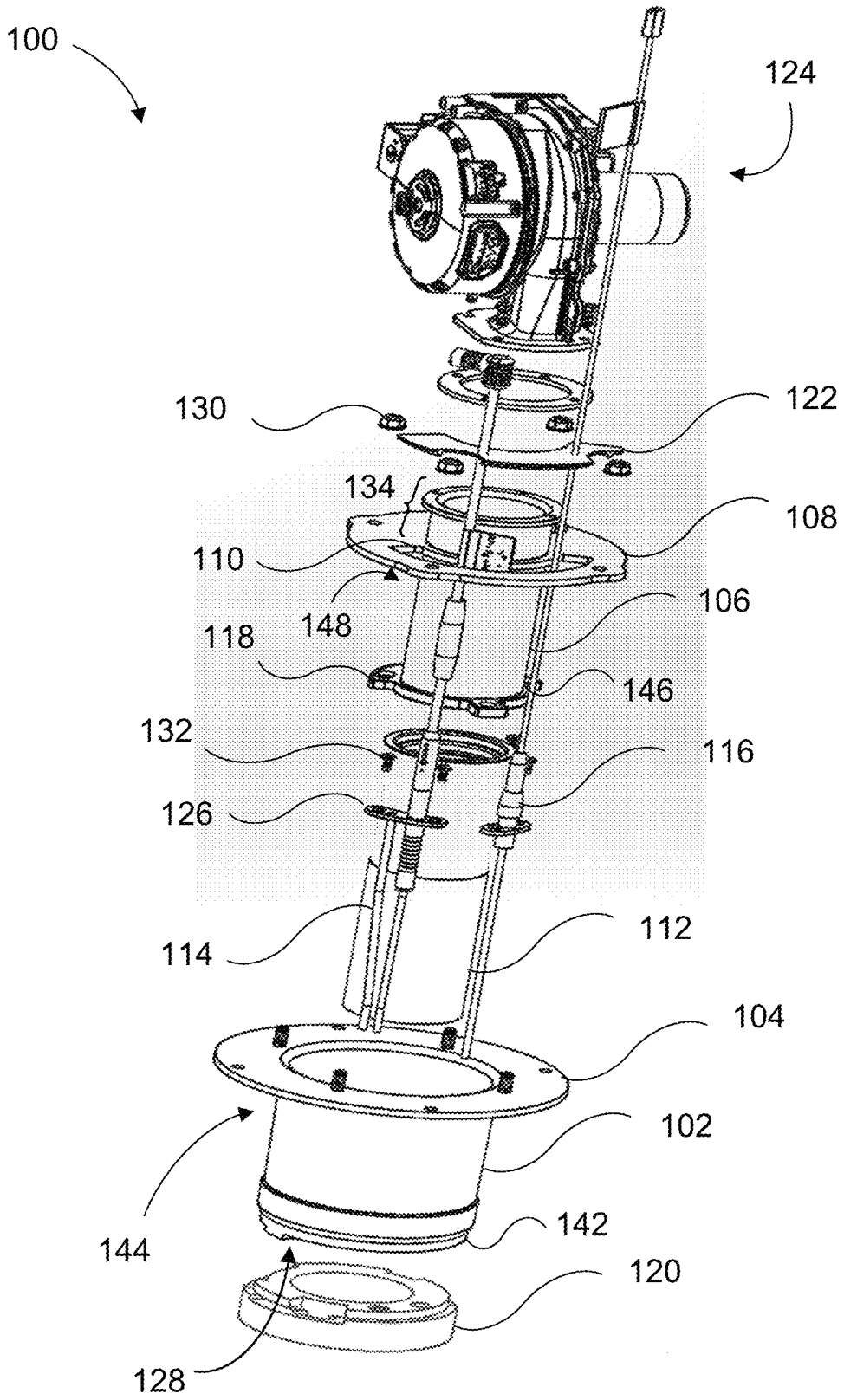
FIG. 3 illustrates an exploded view of an example combustion system according to the disclosed technology.
Figure 4:
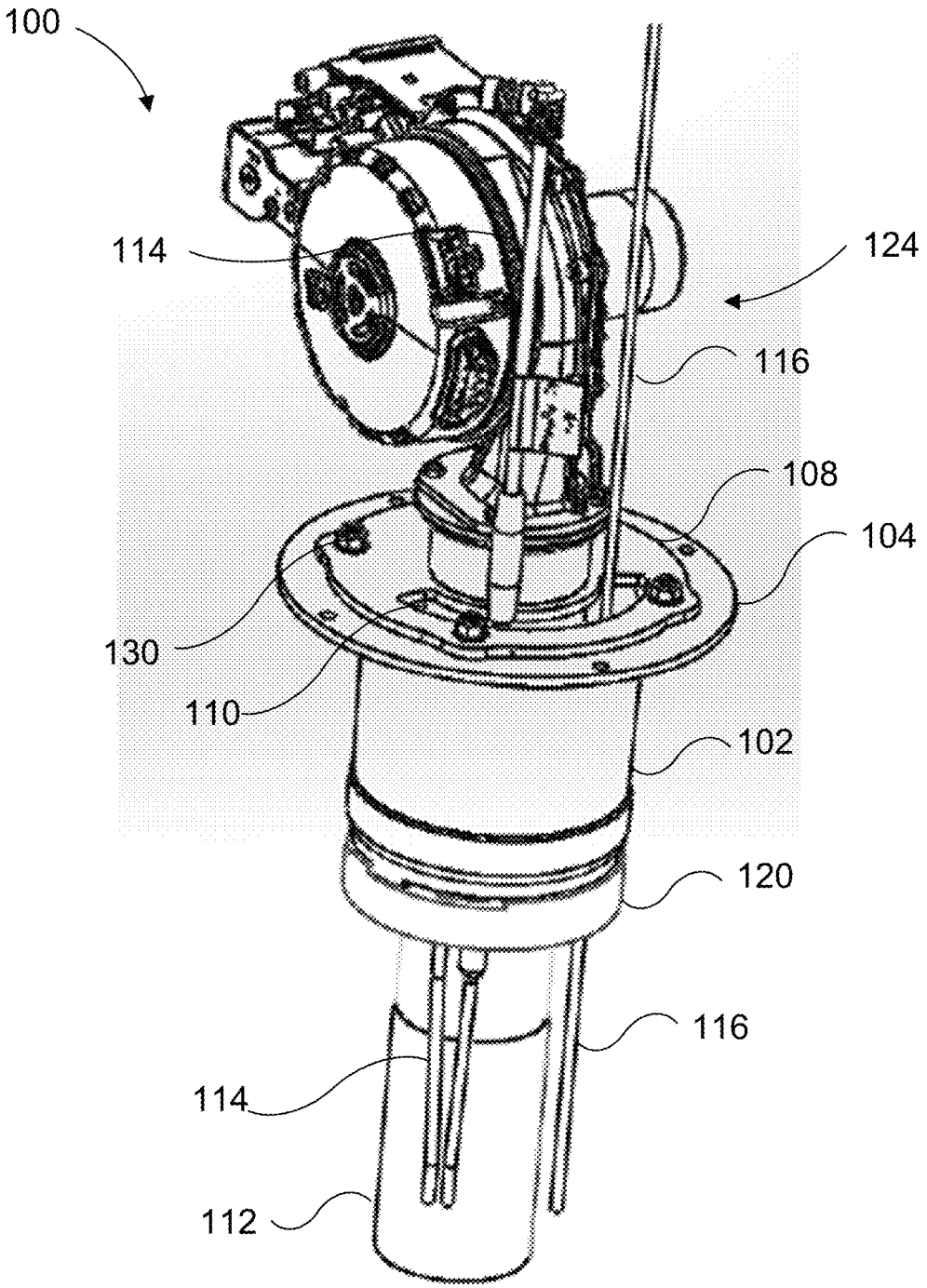
FIG. 4 illustrates an assembled view of an example combustion system, according to the disclosed technology.

FIGS. 3 and 4 illustrate an example combustion system 100. FIG. 3 illustrates an exploded view of the example combustion system 100. The combustion system 100 can include an outer tube 102, an inner tube 106 having a flange 108 with a sensor port 110, a burner 112, an ignitor assembly 114, and a flame sensor assembly 116. At least a portion of the inner tube 106 can be disposed within the outer tube 102. The burner 112 can be in communication with the outer tube 102 and the inner tube 106. The flame sensor assembly 116 and the ignitor assembly 114 can extend through the sensor port 110 of the flange 108 and along a gap between the inner tube 106 and the outer tube 102 and be positioned proximate to the burner 112. The sensor port 110 can provide access to the ignitor assembly 114 and the flame sensor assembly 116, such that the ignitor assembly 114 and the flame sensor assembly 116 can each be easily removed from the combustion system 100 for service without removing other components of the combustion system 100. A blower assembly 124 can be removably fixed to the inner tube 106. The combustion system 100 can be mounted to a tank ring 14 of a combustion tube 12 such that the outer tube 102, the inner tube 106, the burner 112, the ignitor assembly 114, and the flame sensor assembly 116 can be disposed within a combustion tube 12.

The outer tube 102 can have a first end 142 and a second end 144. The first end 142 can be the bottom end of the outer tube 102. The second end 144 can be the top end of the outer tube. The outer tube 102 can be a substantially cylindrical hollow tube and have a circular cross-sectional area, as illustrated in FIG. 3. The outer tube 102 can have a variety of cross-sectional areas, including but not limited to, elliptical, rectangular, triangular, or polygonal. The outer tube 102 can have an inner diameter and an outer diameter. The inner diameter of the outer tube 102 can be between approximately 3 inches to approximately 8 inches. In some embodiments, the inner diameter of the outer tube 102 can be approximately 5 inches. The inner diameter of the outer tube 102 can be sized to receive the inner tube 106. The outer diameter of the outer tube 102 can be sized to be disposed within the combustion tube 12 of the fluid heating device 1. In an example embodiment, the length of the outer tube 102 can be between approximately two inches to approximately five inches. Alternatively, different lengths may be appropriate for other configurations. The outer tube 102 can be made of thermally conductive metal, including but not limited to, aluminum, copper, stainless steel, and alloys thereof.

The outer tube 102 can include a flange 104. The flange 104 can be disposed at the second end 144 of the outer tube 102. The flange 104 can be integral to the outer tube 102. In this configuration, the flange 104 can be pre-molded during manufacturing of the outer tube 102 to provide ease of assembly and manufacturability. By way of example, the flange 104 can be manufactured to be integral to the outer tube 102 through a die casting process. Alternatively, the flange 104 can be an individual component that can be affixed to the outer tube 102. The flange 104 can be affixed to the outer tube 102 via one or more screw, bolt, weld, or other attachment mechanism or substance. The flange 104 can be substantially circular. Alternatively, the flange 104 can have any shape including but not limited to, oval, rectangular, polygonal, and the like. The flange 104 can include one or more attachment mechanisms configured to affix the flange 104 to the tank ring 14 of the combustion tube 12. The attachment mechanism can include one or more screw, bolt, or other attachment mechanism or substance. The flange 104 can be configured to removably attach to the flange 108 of the inner tube 106.

The outer tube 102 can include a refractory assembly 120. The refractory assembly 120 can protect components of the combustion system 100 from high temperatures associated with combustion. The refractory assembly 120 can be removably fixed to the first end 142 of the outer tube 102. The refractory assembly 120 can include recessions and protrusions such that the refractory assembly 120 can be removably fixed to the first end 142 of the outer tube 102 via a twist and lock mechanism. In some instances, the refractory assembly 120 can be affixed to the first end 142 of the outer tube 102 via a stainless-steel spring or via a friction fit when the refractory assembly 120 is oversized. The refractory assembly 120 can include one or more openings configured to receive the ignitor assembly 114 and the flame sensor assembly 116, such that the ignitor assembly 114 and the flame sensor assembly 116 can extend through the refractory assembly 120 and be positioned proximate the burner 112.

The outer tube 102 can include a sight glass window 128. The sight glass window 128 can be affixed to the first end 142 of the outer tube 102. The sight glass window 128 can allow the ignitor assembly 114 and the flame sensor assembly 116 to be viewed through the sensor port 112 without disassembling various components of the combustion system 100. A user and/or or technician can use the sight glass window 128 to quickly and easily see whether the burner assembly 112, ignitor assembly 114, and flame sensor assembly 116 are operating to produce sparks needed for combustion. In this sense, the sight glass window 128 can allow the user and/or technician to determine if the ignitor assembly 114 and/or the flame sensor assembly 116 need to be cleaned and/or serviced. The sight glass window 128 can be attached permanently or can be detachably attached by any useful attachment mechanism.

The inner tube 106 can include a first end 146 and a second end 148. The first end 146 can be the bottom end of the inner tube 106 and the second end 148 can be the top end of the inner tube 106. The inner tube 106 can be a substantially cylindrical hollow tube and have a circular cross-sectional area. The inner tube 106 can have a variety of cross-sectional areas, including but not limited to, elliptical, rectangular, triangular, or polygonal. The inner tube 106 can have an outer diameter and an inner diameter. The outer diameter of the inner tube 106 can be smaller than the inner diameter of the outer tube 102, such that when at least a portion of the inner tube 106 is inserted within the outer tube 102, a gap 140 between the exterior wall of the inner tube 106 and the interior wall of the outer tube 102 can be created. The outer diameter of the inner tube 106 can be between approximately two inch to approximately three inches. The length of the inner tube 106 can be between approximately 4 inches and approximately 6 inches. The length of the inner tube 106 can be sized such that the ignitor assembly 34 and the flame sensor assembly 35 are accessible through the sensor port 110 of the flange 108.

The inner tube 106 can include a blower collar 134. The blower collar 134 can be proximate to the second end 148 of the inner tube 106. The inner tube 106 can be manufactured (e.g., die-casted) to include the blower collar 134 to provide ease of manufacturability and ease of attachment of the blower assembly 124. The blower collar 134 can include a pressure measurement tap configured to monitor pressure of fuel within the blower assembly 124. By incorporating the blower collar 134 with the inner tube 106, the blower assembly 124 can be mounted to the inner tube 106 using a reduced number of attachment mechanisms, as compared to the combustion systems 20, 30 in the prior art.

The inner tube 106 can include a flange 108. The flange 108 can be disposed proximate the second end 148 of the inner tube 106. The flange 108 can be integral to the inner tube 106. In this configuration, the flange 108 can be pre-molded such that the inner tube 106 can be manufactured with the flange 108 to provide ease of manufacturability. Alternatively, the flange 108 can be a separate component that can be affixed to the inner tube 106. The flange 108 can be substantially circular, as illustrated in FIG. 3. Alternatively, the flange 108 can have any shape, including but not limited to, rectangular, polygonal, and the like.

The flange 108 can be removably fixed to the flange 104 of the outer tube 102. Alternatively, the flange 108 can be removably fixed to the second end 144 of the outer tube 102. The flange 108 can be removably fixed to the outer tube 102 using one or more attachment mechanism 130. The one or more attachment mechanism 130 can include one or more screws, bolts, or the like.

Figure 6A:
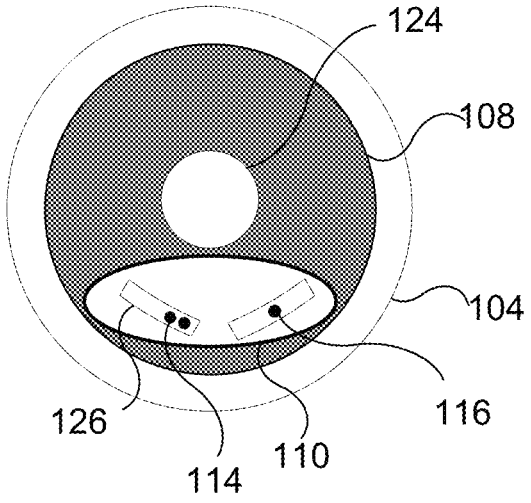
FIGS. 6A-6C illustrate example configurations of a sensor port, according to the disclosed technology.
Figure 6B:
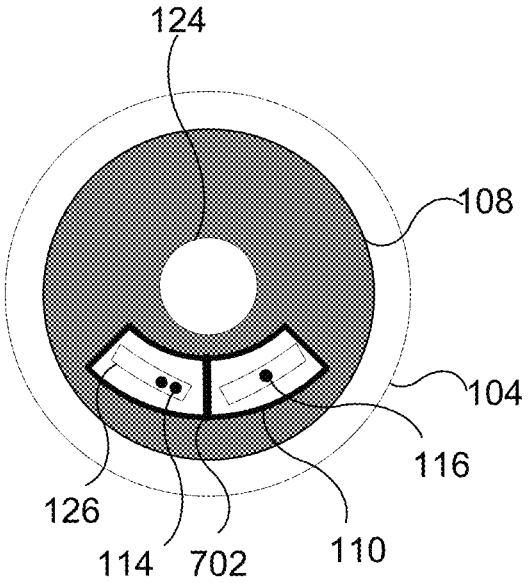
Figure 6C:
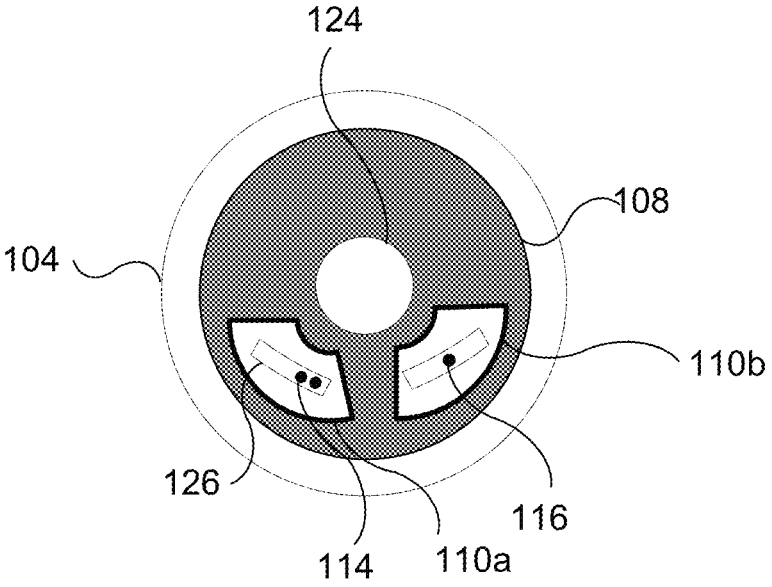

The flange 108 can include a sensor port 110. The sensor port 110 can have a plurality of configurations as illustrated in FIGS. 6A through 6C. As illustrated in FIGS. 3 and 4, the sensor port 110 can have a substantially arc shape. The sensor port 110 can be aligned with the gap 140. When the sensor port 110 is aligned with the gap 140, the sensor port 110 can provide access to the ignitor assembly 114 and the flame sensor assembly 116. The sensor port 110 can be an aperture sized such that the ignitor assembly 114 and the flame sensor assembly 116 each can be removed through the sensor port 110. The ignitor assembly 114 and the flame sensor assembly 116 can each be removed separately. Alternatively, the ignitor assembly 114 and the flame sensor assembly 116 can be removed concurrently. The ignitor assembly 116 can be removed without removing the flame sensor assembly 116, and the flame sensor assembly 116 can be removed without removing the ignitor assembly 116. The ignitor assembly 114 and the flame sensor assembly 116 can be removed through the sensor port 110 without removing additional components of the combustion system 100, including the blower assembly 124 and/or the burner 112. A cover 122 can be disposed at least partially on the sensor port 110. The cover 122 can at least partially prevent unwanted material or debris from entering the sensor port 110 and damaging a component of the combustion system 100.

Figure 5:
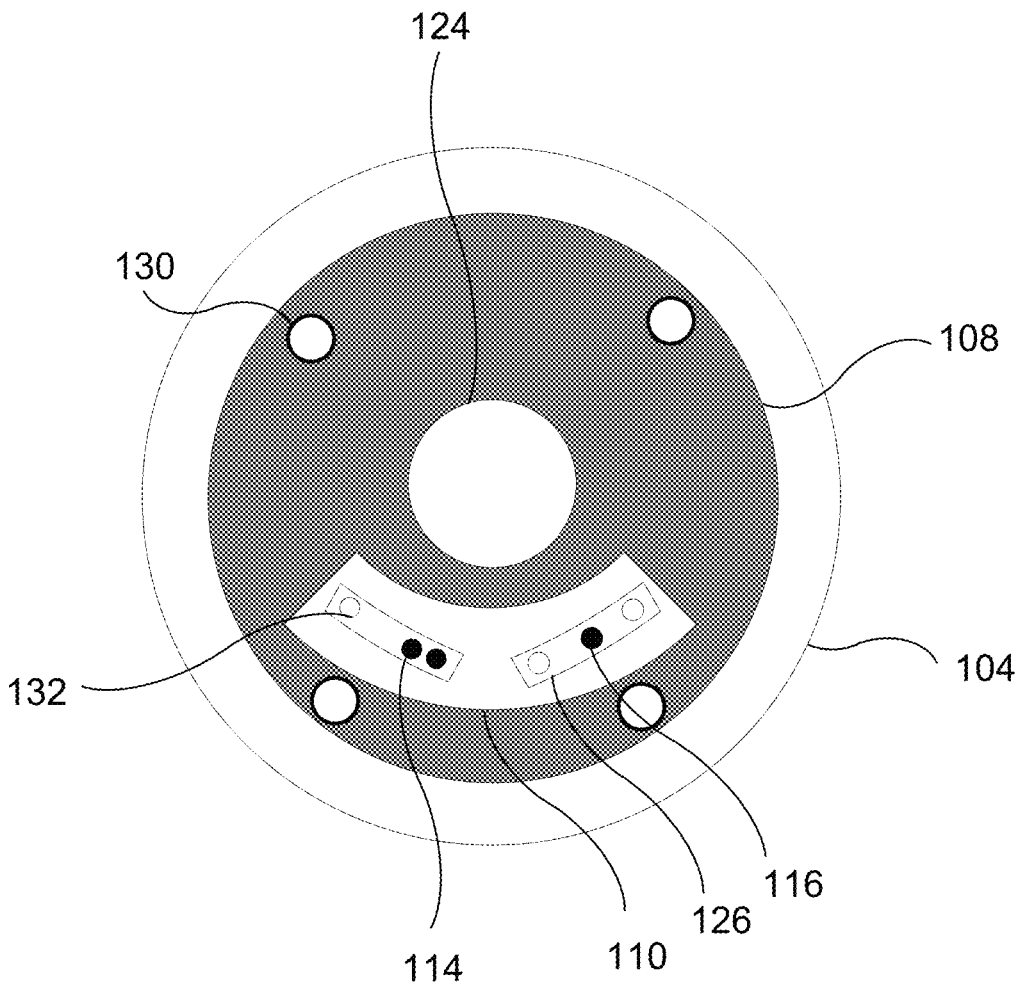
FIG. 5 illustrates a top perspective of a flange having a sensor port, according to the disclosed technology.

The burner 112 can be substantially cylindrical. Although FIGS. 4 and 5 illustrate the burner 112 having a substantially cylindrical shape, it is contemplated that the burner 112 can have any shape. The burner 112 can be substantially flat. The burner 112 can be a fiber mesh burner. The burner 112 can have a length of between approximately four inches and approximately twelve inches. The burner 112 can be in communication with the first end 142 of the outer tube 102. The burner can be affixed to the first end 142 outer tube 102. The burner 112 can be in communication with the refractory assembly 120 affixed to the first end 142 of the outer tube 102. The burner 112 can be in fluid communication with the first end 146 of the inner tube 106 such that the burner 112 can receive an air/fuel mixture from the blower assembly 124. A gasket 118 disposed at the first end 146 of the inner tube can create a seal with the burner 112, such that the burner 112 can receive an air/fuel mixture from the blower assembly 124. The gasket 118 can be over-molded during manufacturing of the inner tube 106 to provide ease of assembly and manufacturability. Alternatively, the gasket 118 can be pre-molded and snapped onto the first end 146 of the inner tube 106 to allow for ease of assembly.

The ignitor assembly 114 can extend through the sensor port 110 and the gap 140 and be positioned proximate the burner 112. The ignitor assembly 114 can ignite incoming fuel, resulting in combustion. The ignitor assembly 114 can include one or more heat resistant wires and an elongated electrode. The one or more heat resistant wires can be disposed proximate to the burner 112 and the elongated electrode can extend from the burner 112 through the gap 140 and the sensor port 110. The elongated electrode can extend to the blower assembly 124. The ignitor assembly 114 can be in electrical communication a controller. The controller can be configured to receive signals from various components of the combustion system 100 and output instructions in response to various components of the combustion system 100. When a demand for heated fluid is detected, the controller can output instructions to the ignitor assembly 114 to generate heat needed for ignition.

The flame sensor assembly 116 can extend through the sensor port 110 and the gap 140 and be positioned proximate the burner 112. The flame sensor assembly 116 can be include a metal rod. The flame sensor assembly 116 can be in electrical communication with the controller. The flame sensor assembly 116 can output a signal to the controller indicating ignition of the combustion gases. The controller can subsequently output instructions to a fuel valve or other component that can control fuel flow into the blower assembly 124.

The flame sensor assembly 116 and the ignitor assembly 114 can be disposed proximate to the burner 112 via one or more mounting bracket 126. The one or more mounting bracket 126 can include openings to receive the flame sensor assembly 116 and/or the ignitor assembly 114. The one or more mounting bracket 126 can include over-molded gaskets configured for proper sealing. One or more attachment mechanism 132 can be used to secure the flame sensor assembly 116 and the ignitor assembly 114. The one or more attachment mechanism 132 can include a screw, bolt, or the like. The mounting brackets 126 can be aligned with the sensor port 110. When the mounting brackets 126 are aligned with the sensor port 110, the one or more attachment mechanism 132 can be accessible. A tool, such as a screwdriver or other device capable of removing attachment mechanisms, can be inserted through the sensor port 110 to loosen and/or remove the attachment mechanisms 132 securing the ignitor assembly 114 and the flame sensor assembly 116 to the mounting bracket 126. Upon loosening and/or removing the attachment mechanisms 132, the ignitor assembly 114 and the flame sensor assembly 116 can be removed through the sensor port 110 and necessary service and/or cleaning can be performed.

The blower assembly 124 can include an inlet for receiving fuel, an inlet for receiving air, and a blower. The inlet for receiving fuel can include a fuel valve configured to control the flow of fuel into the blower assembly 124 in response to signals from the controller. Incoming fuel and air can combine such that a fuel/air mixture can enter the blower. The fuel/air mixture can be transferred to the burner 112, resulting in combustion.

The blower assembly 124 can be removably fixed to the inner tube 106. The blower assembly 124 can be fixed to the blower collar 134 of the inner tube 106. By affixing the blower assembly 124 to the inner tube 106, the air/fuel mixture can be directed through the inner tube 106 and to the burner 112.

FIG. 4 illustrates the combustion system 100 as assembled prior to being mounted on the tank ring 14 of the combustion tube 12. At least a portion of the inner tube 106 can be inserted into the outer tube 102. The first end 146 of the inner tube 106 can include design details, including ridges, protrusions, recessions, and the like. The design details can provide single orientation assembly when the inner tube 106 is inserted into the outer tube 102. The design details can also provide for an over-molding feature for a gasket that can facilitate assembly and disassembly during manufacturing and maintenance. The first end 142 of the outer tube 102 can include design details that can facilitate single orientation assembly when the inner tube 106 is inserted into the outer tube 102. The burner 112 can be in fluid communication with the first end 146 of the inner tube 106 such that the burner 112 can receive an air/fuel mixture from the blower assembly 124. The burner 112 can be affixed to the first end 142 of the outer tube 102. The ignitor assembly 114 and the flame sensor assembly 112 can be inserted through the sensor port 110 such that the ignitor assembly 114 and the flame sensor assembly 116 can extend through the gap 126 created between the exterior wall of the inner tube 106 and the interior wall of the outer tube 102 when the inner tube 106 is inserted within the outer tube 102. The ignitor assembly 114 and the flame sensor assembly 116 can be positioned proximate to the burner 112. The first end 142 of the outer tube 102 can include fastening details that can facilitate positioning the ignitor assembly 114 and the flame sensor assembly 116 proximate to the burner 112. The flange 108 of the inner tube 106 can be mounted to the outer tube 102. The flange 108 of the inner tube 106 can be mounted to the flange 104 of the outer tube 102. One or more attachment mechanisms 130 can removably fix the flange 108 to the outer tube 102. The one or more attachment mechanism 130 can include a screw, a bolt, or the like. The sensor port 110 of the flange 108 can be aligned with the gap 140 created between the interior wall of the outer tube 102 and the exterior wall of the inner tube 106 when the inner tube 106 is disposed within the outer tube 102. The blower assembly 124 can be mounted to the inner tube 106.

The assembled combustion system 100 can be mounted to the tank ring 14 of the fluid heating device 10. When mounted to the tank ring 14, the outer tube 102, the inner tube 106, and the burner 112 can be disposed within the combustion tube 12. The position of the burner 112 with respect to the heat exchanger of the fluid heating device 10 can affect efficiency and effectiveness of combustion and heat transfer. By inserting the inner tube 106 within the outer tube 102, the burner 112 can be positioned between approximately five inches to approximately twelve inches within the combustion tube 12.

The configuration of the combustion system 100 can provide distinct advantageous as compared to the prior combustion systems. By positioning the burner 112 deeper within the combustion tube 12 as compared to prior combustion systems, including the combustion system 1 illustrated in FIG. 1, the burner 112 can be positioned closer to the heat exchanger, resulting in improved combustion and heat transfer. However, unlike some combustion systems known in the prior art, this configuration does not position the burner 112 too deep within the combustion tube 12 such that the ignitor assembly 114 and the flame sensor assembly 116 can be difficult to access and/or remove. Additionally, by inserting the inner tube 106 within the outer tube 102, the length of the ignitor assembly 114 and the flame sensor assembly 116 can remain relatively short as compared to some combustion systems known in the prior art, resulting in reduced costs.

FIG. 5 illustrates a top perspective of the flange 108 of the inner tube 106 affixed to the flange 104 of the outer tube 102. The flange 108 can be affixed to the flange 104 using one or more attachment mechanisms 130. The one or more attachment mechanisms 130 can include screws, bolts, or the like. The flange 108 can be affixed to the flange 104 using four screws. The flange 104 can have substantially the same diameter as the flange 108. In this configuration, when assembled, the flange 108 can completely cover the flange 104, except for the portion exposed by the sensor port 110. Alternatively, the flange 108 can have a smaller diameter than the flange 104, as illustrated in FIG. 5, or a larger diameter than the flange 104. Although the flanges 104, 108 are illustrated as substantially circular, it is contemplated that the flanges 104, 108 can have any shape, including but not limited to, rectangular, polygonal, elliptical, triangular, or the like. The flanges 104, 108 can have the same shape. Alternatively, the flanges 104, 108 can have different shapes.

The sensor port 110 of the flange 108 can provide access to the ignitor assembly 114 and the flame sensor assembly 116. The ignitor assembly 114 and the flame sensor assembly 116 can be disposed proximate to the burner 112 using one or more mounting bracket 126 and one or more attachment mechanism 130. The mounting brackets 126 can include one or more openings configured to receive the ignitor assembly 114 and the flame sensor assembly 116. One or more attachment mechanism 132 can be inserted into the mounting brackets 126 to position the ignitor assembly 114 and the flame sensor assembly 116 proximate to the burner 112. The attachment mechanisms 132 can include screws, bolts, or the like. The mounting brackets 126 and the attachment mechanisms 132 can be aligned with the sensor port 110 such that the attachment mechanisms 132 can be easily loosened and/or removed allowing the flame sensor assembly 116 and the ignitor assembly 114 to be removed from the combustion system 100 without removing any other component, including the blower assembly 124 and/or the burner 112. This ease of accessibility can allow the flame sensor assembly 116 and the ignitor assembly 114 to be easily removed and appropriately serviced in a time efficient manner.

FIGS. 6A through 6C illustrates various non-limiting examples of configurations of the sensor port 110. The sensor port 110 can have a plurality of shapes. As illustrated in FIG. 6A, the sensor port 110 can have a substantially oval shape. Alternatively, the sensor port 110 can have a substantially rectangular, polygonal, or the like shape. FIG. 6B illustrates the sensor port 110 can have a separator 702. The ignitor assembly 114 can be aligned with the sensor port 110 on one side of the separator 702, while the flame sensor assembly can be aligned with the sensor port 110 on the other side of the separator 702. FIG. 6C illustrates flange 108 can include a first sensor port 110*a* and a second sensor port 110*b*. The first sensor port 110*a* can provide access to the ignitor assembly 114 positioned proximate the burner 112 via the mounting bracket 126. The second sensor port 110*b* can provide access to the flame sensor assembly 116 positioned proximate the burner 112 via the mounting bracket 126. With each configuration illustrated in FIG. 6A through 6C, the sensor port 110, 110*a*, 110*b* can provide access to the ignitor assembly 114 and the flame sensor assembly 116. The sensor port 110, 110*a*, 110*b* can be sized such that the attachment mechanisms 132 securing the ignitor assembly 114 and the flame sensor assembly 116 to the mounting bracket 126 can be loosened and/or removed. Upon loosening and/or removing the attachment mechanisms 132, the flame sensor assembly 116 and the ignitor assembly 114 can each be removed through the sensor port 110, 110*a*, 110*b*. The flame sensor assembly 116 and the ignitor assembly 114 can be removed individually. Alternatively, the ignitor assembly 114 and the flame sensor assembly 116 can be removed simultaneously and together as a unit. The flame sensor assembly 116 and the ignitor assembly 114 can be removed and serviced without disassembling or removing other components of the combustion system 100. The flame sensor assembly 116 and the ignitor assembly 114 can be removed without removing the blower assembly 124 and/or the burner 112.

Figure 7:
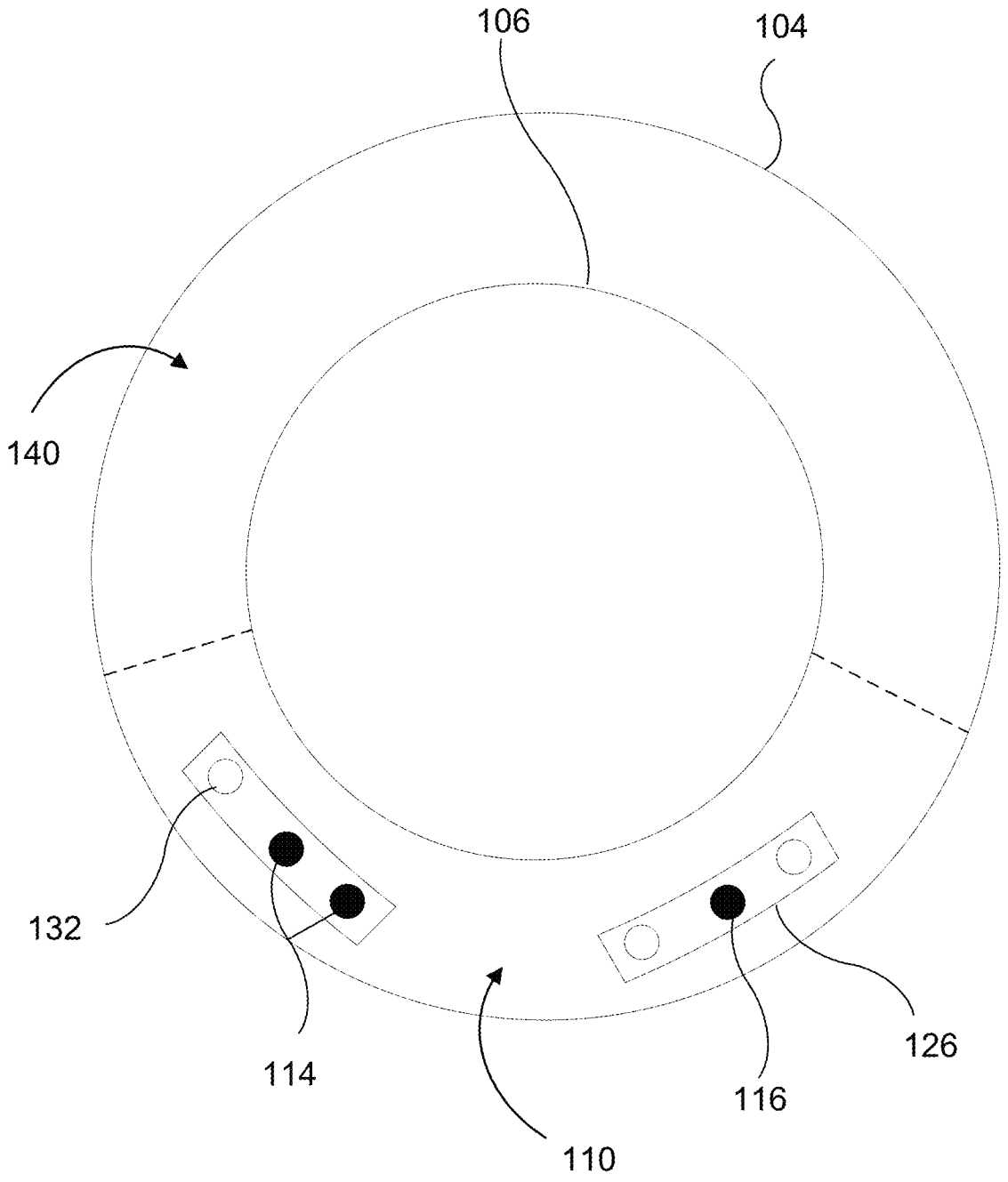
FIG. 7 illustrates a cross-sectional view of an inner tube disposed within an outer tube, according to the disclosed technology.

FIG. 7 illustrates a cross-sectional view of the inner tube 106 disposed within the outer tube 102. When the inner tube 106 is disposed within the outer tube 102, a gap 140 between the interior wall of the outer tube 102 and the exterior wall of the inner tube 106 can be created. The width of the gap 140 can be approximately the difference between the diameter of the outer tube 108 and the diameter of the inner tube 106. The width of the gap 140 can be between approximately 1.5 inches to approximately 2.5 inches. In some instances, the width of the gap 140 can be approximately 1.8 inches. The flame sensor assembly 116 and the ignitor assembly 114 can extend through the gap 140 and be positioned proximate to the burner 112. The ignitor assembly 114 and the flame sensor assembly 116 can be positioned proximate to the burner 114 via the mounting brackets 126 and attachment mechanisms 132. The flame sensor assembly 116 and the ignitor assembly 114 can be aligned with the sensor port 110. In this configuration, the attachment mechanisms 132 can be accessed and removed through the sensor port 110. The attachment mechanism 132 can be removed, allowing the flame sensor assembly 116 and the ignitor assembly 114 to be removed and serviced when necessary.

During the lifespan of the fluid heating device 10, the performance of the flame sensor assembly 116 and the ignitor assembly 114 can begin to deteriorate from an accumulation of dirt, dust, corrosion, and the like. During the lifespan of the fluid heating device 10, components of the combustion system 100, including the flame sensor assembly 116 and the ignitor assembly 114 can require maintenance and/or replacement. Without regular cleaning and service, the ignitor assembly 114 can become unable to generate sufficient sparks to cause ignition and the flame sensor assembly 116 can become unable to accurately determine occurrence of a flame. To ensure the fluid heating device 10 is operating efficiently and effectively, the ignitor assembly 114 and the flame sensor assembly 116 can be regularly serviced and cleaned by removing each component and providing the necessary maintenance. For example, certain manufacturers may recommend that the ignitor assembly 114 and the flame sensor assembly 116 be serviced and cleaned at least once per year.

When servicing the ignitor assembly 114 and/or the flame sensor assembly 116, the one or more attachment mechanisms 132 can be removed using a tool, including a screwdriver or other similar device. The tool can be inserted through the sensor port 110 of the flange 108 to easily remove the one or more attachment mechanisms 132. Upon removing the one or more attachment mechanisms 132, the ignitor assembly 114 and/or the flame sensor assembly 116 can be removed from the combustion system 100 through the sensor port 110. The ignitor assembly 114 can be removed separately from the flame sensor assembly 116. Alternatively, the ignitor assembly 114 and the flame sensor assembly 116 can be concurrently. Upon removal, the ignitor assembly 114 and the flame sensor assembly 116 can be appropriately cleaned and serviced. The accessibility of the ignitor assembly 114 and the flame sensor assembly 116 through the sensor port 110 can eliminate the need to remove the blower assembly 124 and/or the burner 112 prior to accessing the ignitor assembly 114 and the flame sensor assembly 114, resulting in reduced labor time and costs.

After the required service and cleaning of the flame sensor assembly 116 and/or the ignitor assembly 114, the ignitor assembly 114 and the flame sensor assembly 116 can be easily returned to the proper location. The ignitor assembly 114 can be inserted through the sensor port 110 and the gap 140 such that the ignitor assembly 114 can return to its position proximate to the burner 112. Similarly, the flame sensor assembly 116 can be inserted through the sensor port 110 and the gap 140 such that the ignitor assembly 114 can return to its position proximate to the burner 112. The attachment mechanisms 132 can be reinserted into the mounting brackets 126, such that the flame sensor assembly 116 and the ignitor assembly 114 are fixed in the appropriate position.

Although the flame sensor assembly 116 and the ignitor assembly 114 can be accessible without removing the blower assembly 124, it is contemplated that the blower assembly 124 and/or the burner 112 can be removed to provide greater access to the ignitor assembly 114 and the flame sensor assembly 116.

Figure 8A:
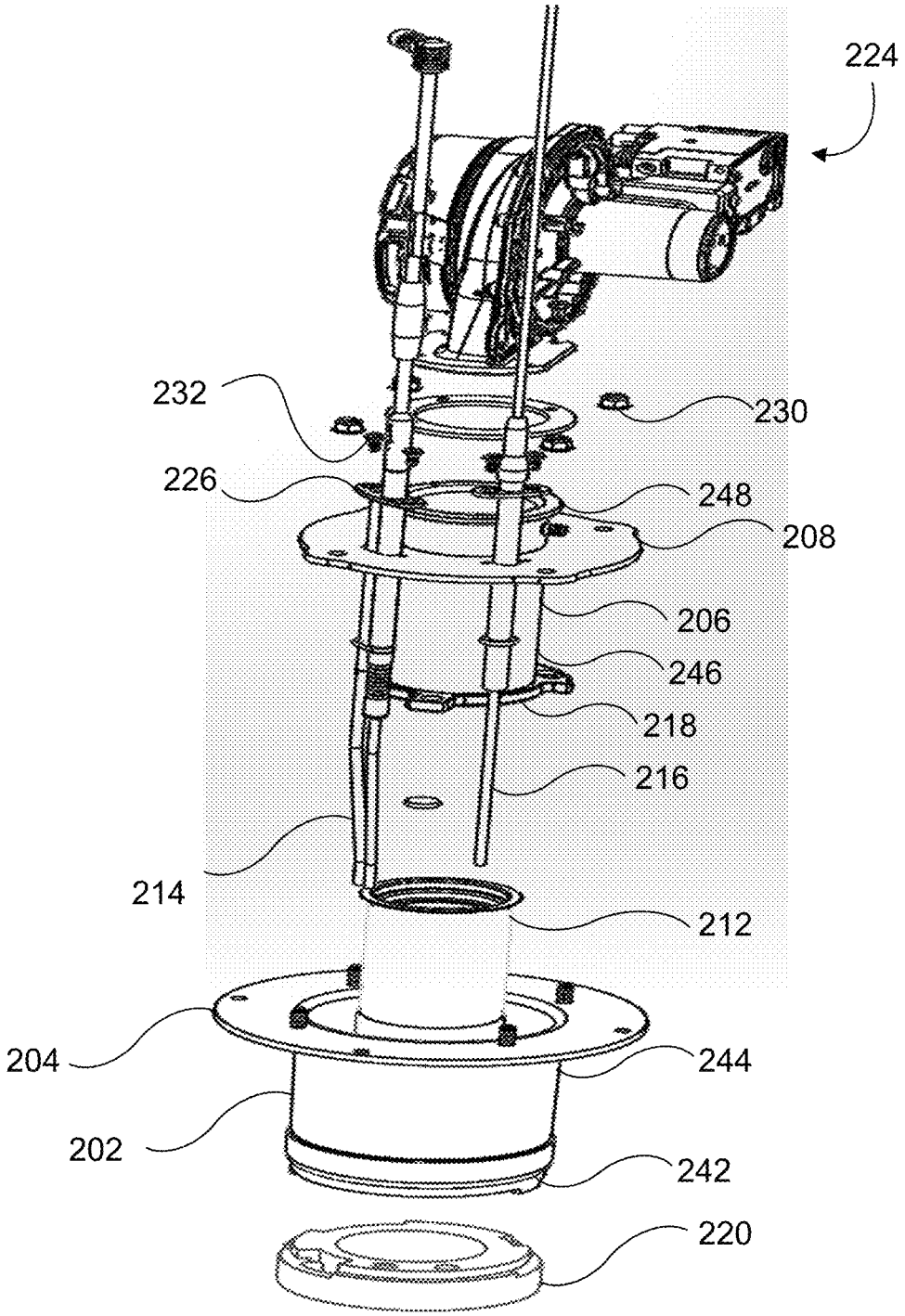
FIG. 8A illustrates an exploded view of an additional example combustion system, according to the disclosed technology.
Figure 8B:
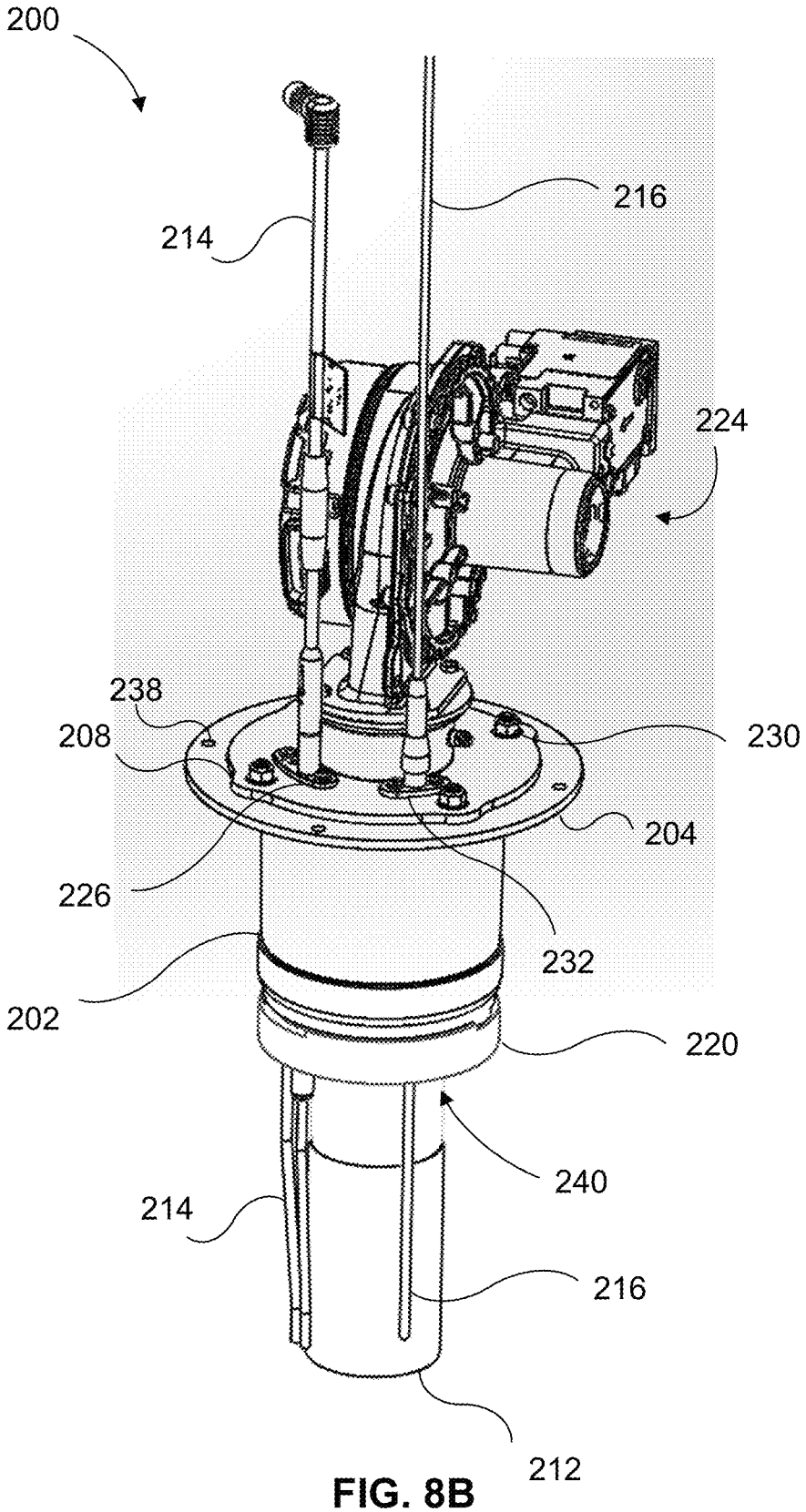
FIG. 8B illustrates an assembled view of the combustion system of FIG. 8A, according to the disclosed technology.

FIGS. 8A and 8B illustrate an additional example of a combustion system 200. FIG. 8A illustrates an exploded view of the combustion system 200. The combustion system 200 can include an outer tube 202, an inner tube 206 having a flange 208, a burner 212, an ignitor assembly 214, and a flame sensor assembly 216. The outer tube 202 can have a first end 242 and a second end 244. The second end 244 can include a flange 204. The first end 242 can include a refractory assembly 220. The refractory assembly 220 can be removably fixed to the first end 242. The refractory assembly 220 can be removably fixed to the first end 242 using a lock and twist mechanism. The inner tube 206 can have a first end 246 and a second end 248. The first end 246 can include a gasket 218. The flange 208 can be disposed proximate the second end 244. The inner tube 206 can have a diameter smaller than a diameter of the outer tube 202, such that when the inner tube 206 is inserted within the outer tube 202, a gap 240 between the inner tube 206 and the outer tube 202 can be created. The width of the gap 240 can be approximately the difference between the diameter of the outer tube 202 and the diameter of the inner tube 206. The burner 212 can be in communication with the first end 242 of the outer tube 202. The burner 212 can be in communication with the refractory assembly 220 removably fixed to the first end 242 of the outer tube 202. In this configuration, the refractory assembly 220 can provide insulation from heat generated during combustion. The burner 212 can be in communication with the first end 246 of the inner tube 206 such that the burner 212 can receive an air/fuel mixture from the blower assembly 224. The burner 212 can be affixed to the first end 242 of the outer tube 102. The flange 208 can include one or more apertures configured to receive the ignitor assembly 214 and the flame sensor assembly 216. One or more mounting bracket 226 and one or more attachment mechanism 232 can removably fix the ignitor assembly 214 and the flame sensor assembly 216 to the flange 208. The combustion system 200 can further include a blower assembly 224.

FIG. 8B illustrates an assembled view of the combustion system 200. In FIG. 8B, at least a portion of the inner tube 206 can be inserted into the outer tube 202. The flange 208 can be mounted to the outer tube 202. The flange 208 can be mounted to the flange 204 of the outer tube 102. One or more attachment mechanism 230 can removably fix the flange 208 to the outer tube 202. The ignitor assembly 214 and the flame sensor assembly 216 can be removably fixed to the flange 208. One or more mounting bracket 226 and one or more attachment mechanism 232 can removably fix the ignitor assembly 214 and the flame sensor assembly 216 to the flange 208. The ignitor assembly 214 and the flame sensor assembly 216 can extend through the gap 240 between the interior wall of the outer tube 202 and the exterior wall of the inner tube 206 such that the ignitor assembly 214 and the flame sensor 216 are positioned proximate the burner 212. The blower assembly 224 can be removably fixed to the inner tube 206. The blower assembly 224 can be removably fixed to the second end 248 of the inner tube 206.

The assembled combustion system 200 can be mounted to a tank ring 14 of a combustion tube 12 via the flange 208 of the inner tube 206 such that the outer tube 202, the inner tube 206, and the burner 212 are disposed within a combustion tube 12. Alternatively, the combustion system 200 can be mounted to the tank ring 14 of the combustion tube via the flange 204 of the outer tube 202.

In order to service the combustion system 200, including the ignitor assembly 214 and the flame sensor assembly 216, the one or more attachment mechanism 232 can be removed. A tool, such as a screwdriver or other device capable of removing screws and/or bolts, can be used to remove the one or more attachment mechanism 232. Because the attachment mechanisms 232 are openly disposed and accessible on the flange 208, the attachment mechanisms 232 can be easily removed in a time efficient manner. Upon removing the one or more attachment mechanism 232, the ignitor assembly 214 and the flame sensor assembly 216 can be removed from the combustion system 200 and appropriately serviced. The ignitor assembly 214 and the flame sensor assembly 216 can be removed from the combustion system 200 without removing additional components of the combustion system 200, including the blower assembly 224 and/or the burner 212.

Certain examples and implementations of the disclosed technology are described above with reference to block and flow diagrams according to examples of the disclosed technology. It will be understood that one or more blocks of the block diagrams and flow diagrams, and combinations of blocks in the block diagrams and flow diagrams, respectively, can be implemented by computer-executable program instructions. Likewise, some blocks of the block diagrams and flow diagrams do not necessarily need to be performed in the order presented, can be repeated, or do not necessarily need to be performed at all, according to some examples or implementations of the disclosed technology. It is also to be understood that the mention of one or more method steps does not preclude the presence of additional method steps or intervening method steps between those steps expressly identified. Additionally, method steps from one process flow diagram or block diagram can be combined with method steps from another process diagram or block diagram. These combinations and/or modifications are contemplated herein.

What is claimed is:

1. A combustion system comprising:

an outer tube having a first end and a second end, the first end in communication with a burner;

an inner tube having an outer diameter, a first end, a second end, and a flange that includes a sensor port, the inner tube being disposed within the outer tube and the outer diameter of the inner tube being less than an inner diameter of the outer tube such that a gap exists therebetween, the sensor port being aligned with the gap, and the flange attached to the second end of the outer tube;

the burner in communication with the first end of the inner tube and extending beyond the first end of the outer tube;

an ignitor assembly extending through the sensor port and the gap; and a flame sensor assembly adjacent to the ignitor assembly and extending through the sensor port and the gap;

wherein each of the ignitor assembly and the flame sensor assembly extend through the sensor port and the gap from a first position adjacent to the burner outside of the first end of the inner tube and the first end of the outer tube to a second position outside of the second end of the inner tube and the second end of the outer tube; and wherein the sensor port comprises a single opening configured to receive both the ignitor assembly and the flame sensor assembly extending through the single opening of the sensor port.

2. The combustion system of claim 1, wherein the sensor port is sized such that each of the ignitor assembly and the flame sensor assembly is removable through the sensor port.

3. The combustion system of claim 1, wherein each of the ignitor assembly and the flame assembly is removable without removing the burner.

4. The combustion system of claim 1, wherein the ignitor assembly and the flame sensor assembly are removable concurrently.

5. The combustion system of claim 1, wherein the second end of the outer tube includes a flange.

6. The combustion system of claim 5, wherein the flange of the inner tube attaches to the flange of the outer tube.

7. The combustion system of claim 1, further comprising a blower assembly removably fixed to the second end of the inner tube.

8. The combustion system of claim 7, wherein each of the ignitor assembly and the flame sensor assembly is removable without removing the blower assembly.

9. The combustion system of claim 1, wherein a portion of the ignitor assembly and a portion of the flame sensor assembly are positioned proximate to the burner via a mounting bracket aligned with the sensor port.

10. The combustion system of claim 1, further comprising a refractory assembly removably fixed to the first end of the outer tube.

11. The combustion system of claim 1, wherein the flange of the inner tube mounts to a tank ring of a combustion tube, such that the inner tube, the burner, and the outer tube are disposed within the combustion tube.

12. The combustion system of claim 5, wherein the flange of the outer tube mounts to a tank ring of a combustion tube, such that the inner tube, the burner, and the outer tube are disposed within the combustion tube.

13. The combustion system of claim 1, further comprising a sight glass window affixed to the first end of the outer tube, a portion of the ignitor assembly and a portion of the flame sensor assembly being visible via the sight glass window.

14. The combustion system of claim 1, wherein the gap has a width of between approximately 1.5 inches and approximately 2.5 inches.

15. A combustion tube assembly comprising:

an outer tube having a first end and a second end;

an inner tube having a first end, a second end, and a flange that includes a sensor port, the inner tube configured to at least partially insert into the outer tube, the inner tube having an outer diameter less than an inner diameter of the outer tube such that a gap exists therebetween, the sensor port being aligned with the gap;

a burner configured to attach to the first end of the outer tube and extend beyond the first end of the outer tube;

an ignitor assembly configured to extend through the sensor port and the gap from a first position adjacent to the burner outside of the first end of the inner tube and the first end of the outer tube to a second position outside of the second end of the inner tube and the second end of the outer tube and proximate the sensor port; and a flame sensor assembly configured to extend through the sensor port and the gap from a first position adjacent to the burner outside of the first end of the inner tube and the first end of the outer tube to a second position outside of the second end of the inner tube and the second end of the outer tube and proximate the sensor port;

wherein the sensor port defines a sensor port width and the gap defines a gap width, and wherein the sensor port width and the gap width are substantially equal.

16. The combustion tube assembly of claim 15, wherein the flange of the inner tube is configured to attach to the second end of the outer tube.

17. The combustion tube assembly of claim 15, wherein the second end of the outer tube includes a flange and the flange of the outer tube is configured to attach to the flange of the inner tube.

18. The combustion tube assembly of claim 15, wherein the second end of the inner tube is configured to attach to a blower assembly.

19. The combustion tube assembly of claim 15, wherein each of the flame sensor assembly and the ignitor assembly is configured to be removable through the sensor port.

20. The combustion tube assembly of claim 15, wherein each of the flame sensor assembly and the ignitor assembly is configured to be removable without removing the burner.

* * * * *